US006034583A

United States Patent [19]

Dittmann

[11] Patent Number: 6,034,583

[45] Date of Patent: Mar. 7, 2000

[54] POLARIZED ELECTROMAGNETIC RELAY

[75] Inventor: Michael Dittmann, Berlin, Germany

[73] Assignee: Siemens Electromechanical Components GmbH & Co. KG, Munich, Germany

[21] Appl. No.: 09/325,866

[22] Filed: Jun. 4, 1999

[30] Foreign Application Priority Data

Jun. 4, 1998 [DE] Germany ..... 19825078.9

[51] Int. Cl.[7] ..... H01H 51/22; H01H 51/08

[52] U.S. Cl. ..... 335/78; 335/79; 335/83

[58] Field of Search ..... 335/78–86, 124, 335/128, 202

[56] References Cited

U.S. PATENT DOCUMENTS

| | | | |
|---|---|---|---|
| 5,337,029 | 8/1994 | Nobutoki et al. | 335/78 |
| 5,617,066 | 4/1997 | Dittmann et al. | 335/78 |
| 5,673,012 | 9/1997 | Stadler et al. | 335/78 |
| 5,734,308 | 3/1998 | Dittmann et al. | 335/78 |

FOREIGN PATENT DOCUMENTS 0 197 391 11/1995 European Pat. Off. .

*Primary Examiner*—Lincoln Donovan
*Assistant Examiner*—Raymond Barrera
*Attorney, Agent, or Firm*—Hill & Simpson

[57] ABSTRACT

A polarized electromagnetic relay has a base body, an armature, an envelope that comprises insulating material, a coil, a core and a bar-shaped magnet. The base plane is defined by a bottom side of the base body. The armature is arranged between two contact springs that lie parallel to each other in a common plane. Two transverse terminal webs, which have their sheet metal plane extending perpendicular to the base plane, extend out of the envelope in the area of the rotational axis of the armature. The terminal webs are respectively connected with fastening tabs that have a sheet metal plane extending perpendicular to the base plane. The contact springs exhibit two spring arms and a connecting web, respectively, which has its sheet metal plane extending perpendicular to the base plane. The spring arms exhibit a contact making part and a part that is embedded in the envelope, respectively. The part that is embedded in the envelope merges into the connecting web.

10 Claims, 2 Drawing Sheets

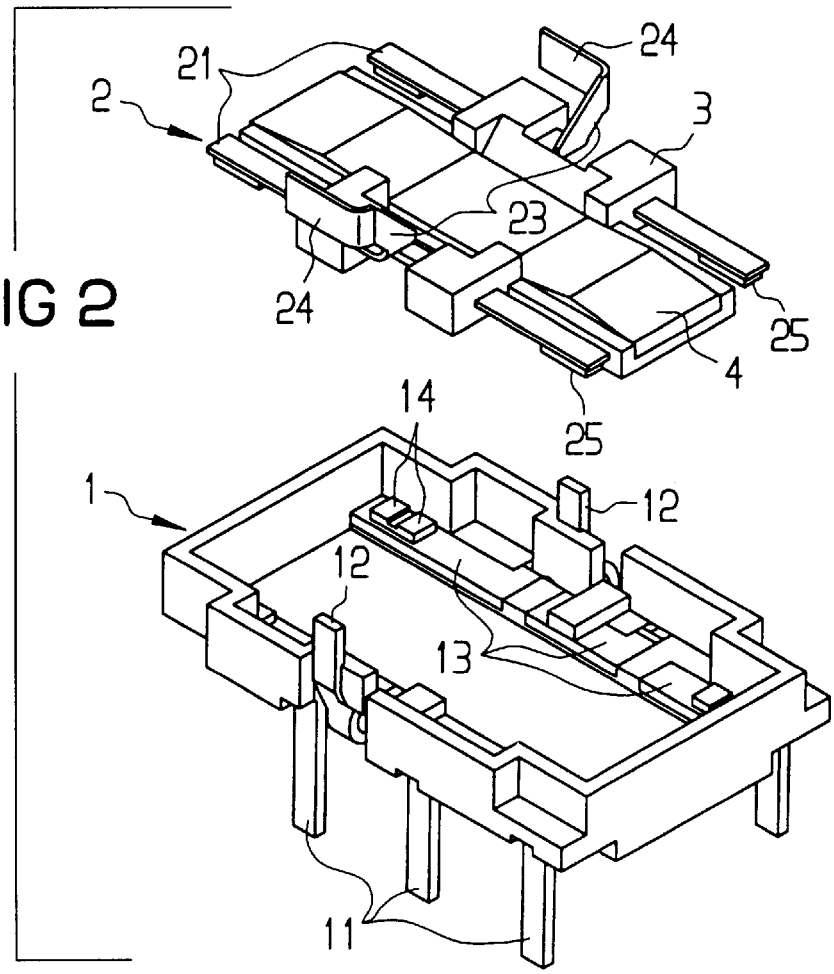
FIG 2
FIG 3
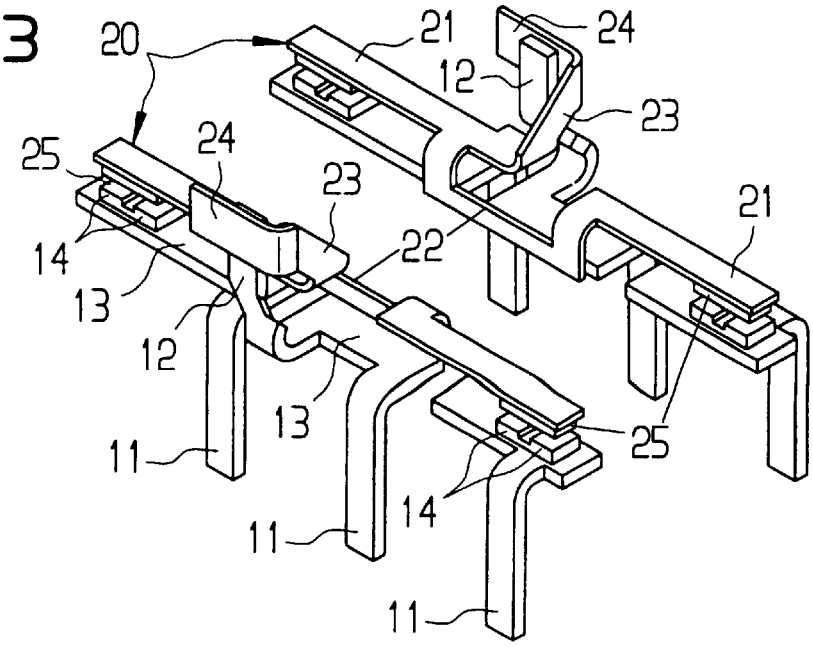

POLARIZED ELECTROMAGNETIC RELAY

BACKGROUND OF THE INVENTION

1. Field of the Invention

The present invention is directed to a polarized electromagnetic relay with a base body comprising an insulating material, which defines a base plane with its bottom side, and in which terminal tracks for stationary contact elements as well as terminal elements for stationary and movable contact elements are embedded, a pivotable armature that is arranged above the base body, whose rotational axis runs parallel to the base plane and which is arranged between at least two contact springs of a contact spring group that is connected to the armature, which springs are arranged in a common plane and run parallel to each other so that the contact springs cooperate with the stationary terminal elements at the base body in response to the movement of the armature, an envelope that comprises insulating material which surrounds the contact springs in a central sector and from which two transverse terminal webs that are connected with the contact springs project in the area of the rotational axis of the armature, whereby the terminal webs are respectively connected with a fastening tab, which has its sheet metal plane extending perpendicular to the base plane, a coil, whose axis runs parallel to the base plane and perpendicular to the armature and whose winding terminal elements pass perpendicularly through the base plane, a core that is arranged axially in the coil and to whose end pole shoes that are directed toward the armature connect and which form at least one working air gap with the armature and at least one bar-shaped permanent magnet, which is arranged parallel to the coil axis between the pole shoes and which generates a like polarization at the ends of the pole shoes.

2. Prior Art

A polarized relay is disclosed in U.S. Pat. No. 4,695,813, whose disclosure is incorporated herein by reference thereto and which claims priority from the same Japanese Application as European 0 197 391 B2. In this U.S. Patent, a polarized relay is disclosed, whose armature is carried by a pair of contact springs. Together with the armature, the contact springs are movable and are provided with a lever arm in their center areas that respectively extends transverse and is connected tightly to a terminal element at a base body. Thus, the lever arms are applied of one-piece to the contact springs and represent elastic torsion elements with a limited deformability. Given the relays of the U.S. Patent, the terminal tabs of the torsion spring webs are bent down and are connected to center contact terminal pieces in a recess in the base body. Thus, accessibility to the fastening points of the terminal tabs of the torsion spring web at the center contact terminal piece is difficult, whereby a simple and precise adjustment is impeded.

SUMMARY OF THE INVENTION

The present invention is directed to the object of creating a polarized relay with a reduced overall height, wherein a precise and permanent adjusting of contact clearances and excess stroke is possible and which is characterized by a high shock resistance.

According to the invention, this is achieved wherein the coil is arranged above the armature, the terminal webs have their sheet metal plane extending perpendicular to the base plane, the contact springs comprise two spring arms and a connecting web, respectively, and the connecting web has its sheet metal plane extending perpendicular toward the base plane. The spring arms comprise a contact making part and a part embedded in the envelope, respectively, whereby the part that is embedded in the envelope merges into a connecting web and the fastening tabs are respectively fastened to a center contact terminal pin that extends perpendicularly out of the base body.

As a result of the inventive solution, it is possible to reduce the overall height of the polarized electromagnetic relay from approximately 10 mm to 5 mm. According to a preferred embodiment, the fastening tab is an extension of a terminal web that is bent in the direction of the coil. Preferably, the terminal web is connected via a leaf spring web to a spring arm of the contact spring. Thus, the terminal web represents an extension of a spring arm that extends toward the rotational axis of the armature and parallel to the axis of the coil and which has its sheet metal plane extending parallel to the base plane. The terminal webs and the fastening tabs that are connected thereto preferably encompass the center contact terminal pins. This contributes to a good accessibility of the fastening points and to an improved adjustment of the contact clearance. Preferably, the connection between the fastening tab and the center contact terminal pins occurs through resistance welding or laser welding. During the assembly, the relay spring group can be introduced into the base body together with the armature respective to the base body or pedestal from above with the help of the fastening tabs that have their sheet metal plane directed perpendicular to the base plane. When a desired contact clearance is reached, the contact spring group is fastened to the base body together with the armature. When, during the installation, the contact spring group is intentionally introduced into the base body with the armature at an angle in a longitudinal direction, then a mechanical monostability of the relay can be preset. This is possible, for example, by choosing a smaller contact clearance at the break contacts than at the make contacts.

For the purpose of reducing the number of necessary relay component parts, the contact springs, which include the connecting webs, the terminal webs and the fastening tabs, are preferably fabricated from a common sheet of metal. The same is valid for the terminal tracks for the stationary contact elements, whereby the terminal elements are formed by terminal tabs of the metal sheet that are bent off perpendicularly.

In an advantageous embodiment of the invention, the envelope of the contact spring group exhibits a receptacle for the armature, so that the relay armature can be arranged insulatingly between the contact springs. Thus, the relay armature is either glued to the envelope of the contact spring group or it is connected by deformable, vertical pegs of the envelope with the contact spring group. Preferably, the relay armature is fashioned planar, so that a coupling piece is arranged between the armature and the at least one permanent magnet for the reduction of the magnetic resistance in the magnetic circuit. This coupling piece can either be fastened to the magnet by laser welding or can be held in the envelope of the coil. An additional reduction of the overall height of the relay results when the armature, from its center area, is bent toward the pole shoes by roughly half of the lifting angle.

Advantageously, the coil, together with the core and the pole shoes, is surrounded by an insulating envelope and a pedestal of the relay is fashioned by the base body, which accepts the armature and the contact spring group so that the insulating envelope together with the bottom side of the pedestal form a housing for the relay. When finishing such a relay, the coil that is surrounded by the insulating envelope is pushed onto the pedestal until the desired armature stroke is reached. Thus, the insulating coating of the coil clamps on the pedestal and the relay can be subsequently sealed with a casting resin.

Other advantages and features of the invention will be readily apparent from the following description of the preferred embodiments, the drawings and claims.

BRIEF DESCRIPTION OF THE DRAWINGS

FIG. 2 is an exploded perspective view of a pedestal or base and a contact spring group together with an armature of the relay of the present invention; and FIG. 3 is a perspective view of the contact springs as well as the terminal tracks and terminal elements that are embedded in the pedestal or base of FIG. 2.

DESCRIPTION OF THE PREFERRED EMBODIMENTS

Figure 1:
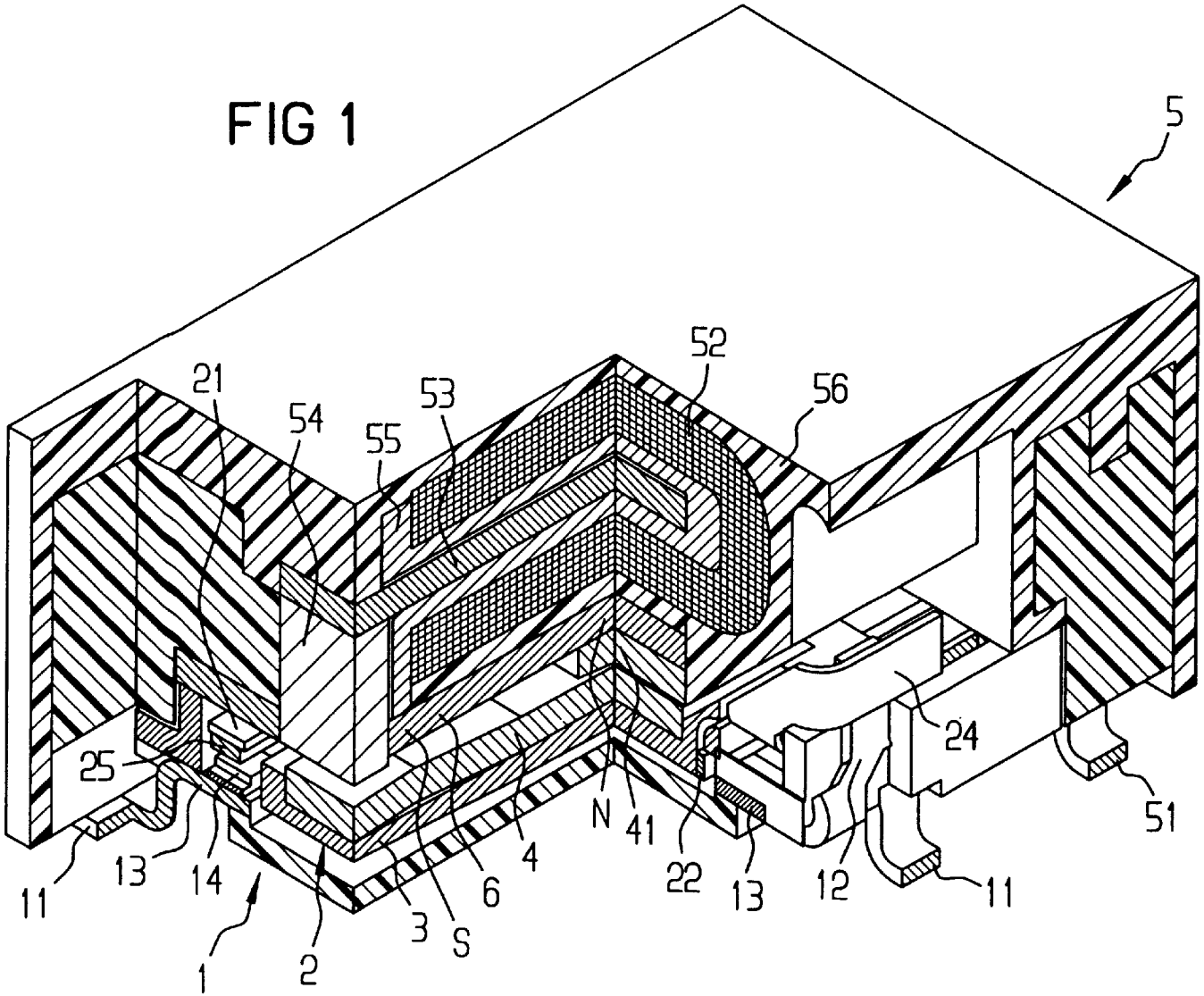
FIG. 1 is an axonometrical sectional view of the relay of the present invention.

A relay of the present invention is illustrated in FIG. 1 and has a housing which is constructed on the bottom side of a pedestal or base, generally indicated at 1, and by an insulating envelope 56 of a coil 5, which envelope is pushed over the base 1. Preferably, the envelope 56 is fashioned by extrusion-coating of the coil 5. Contact terminal elements 11 and winding terminal elements 51 extend through the bottom side of the base 1 that represents the base plane of the relay. A contact spring group 2 and an armature 4 are arranged above the base 1 and below the coil 5, and are best illustrated in FIG. 2. The contact spring group 2 has an envelope 3 that is composed of insulating material, in which two contact springs 20 are embedded to lie parallel to one another in a common plane.

Preferably, the envelope 3 is fashioned by an extrusion-coating of the contact springs 20. Each contact spring 20 comprises a connecting web 22, which is best illustrated in FIG. 3, and two spring arms 21. Contact making ends of the spring arms 21 extend out of the envelope 3, as best illustrated in FIG. 2, and the spring arms 21 have contact pieces or pads 25 of a profile material welded on their ends. The parts of the spring arms 21 that are embedded in the envelope 3 directly merge into the connecting webs 22, as illustrated in FIG. 3. In addition, the envelope 3 exhibits a receptacle for the armature 4, namely the armature is arranged and insulated between the relay springs 20 and secured thereto.

A core 53 (FIG. 1), to whose end pole shoes 54 are directed toward the armature 4 to form a connect, is arranged axially in the coil 5. A bar-shaped three-pole permanent magnet 6 is arranged parallel to the axis of the coil between the pole shoes 54 to generate like polarizations S at the ends of each pole shoe 54.

In order to reduce the magnetic resistance between the armature 4 and the permanent magnet 6, a coupling piece 41 is arranged between the armature and the magnet 6 in the area of the rotational axis of the armature. Given a relay according to FIG. 1, the terminal elements 11 for the relay elements 14 and 25 can be realized as surface mounted technology-terminal contacts or SMT-terminal pads or contacts. On principle, they can also be fashioned as insert pins.

A base or pedestal 1 that is composed of insulating material has terminal tracks 13 for stationary contact elements 14 that are manufactured by a common sheet of metal being embedded in the base. The stationary contact elements 14 are welded on the terminal tracks 13. The contact terminals 11 are fashioned by bending down tabs of the common metal sheet for the terminal tracks 13, as best illustrated in FIG. 3. The same is valid for the center contact terminals, which are also fashioned by bending terminal tabs of the terminal tracks. The center contact terminal pins 12 are fashioned by terminal tabs that are bent upward, while the terminal elements 11 of the center contacts are bent downward and extend through the bottom side of the base 1.

With the help of FIGS. 2 and 3, it can be seen that the contact spring group 2 comprises two contact springs 20, which are separated from each other and extend parallel to each other and that they carry switch contacts 25 that are welded on their spring arms 21. The contact springs 20 are preferably formed from a common sheet of metal and are surrounded in their center section by an insulating envelope 3. Apart from the contact making ends of the spring arms 21, two transverse terminal webs 23 extend out of the envelope 3 in the area of the rotational axis of the armature, and have their sheet metal plane extending perpendicular to the base plane. The terminal webs 23 are respectively connected via a leaf spring web with the spring arm 21 of the contact spring 20. Thus, the leaf spring web represents an extension of the spring arm 21 that extends parallel to the axis of the coil to the area of the rotational axis of the armature and which has its sheet metal plane extending essentially parallel to the base plane. Moreover, the contact spring group 2 exhibits two fastening tabs 24, which have their sheet metal plane directed perpendicular to the base plane. The fastening tabs 24 are respectively fastened to the center contact terminal pins 12, which extend perpendicular out of the base 1 and are connected to the contact spring 20 via the terminal webs 23. In addition, the height of the vertical terminal webs 23 increases ramp-like up to the fastening tab 24 from the side that faces the armature 4 and, thus, the webs 23 slope outwardly from the contact spring 20. The connecting web 22 is surrounded entirely by the insulating envelope 3 and has its sheet metal plane directed perpendicular to the base plane, as shown in FIG. 3.

Since the center contact terminal pins 12 and the fastening tabs 24 have welding surfaces, which lie next to each other in a plane that is perpendicular to the base plane, the contact spring group can be introduced into the base 1 together with the armature 4 from above during the assembly operation. When a desired contact clearance is reached, the fastening tabs which engage the center contact terminal pins 12 together with the terminal webs 3 are welded on the welding surfaces of the center contact terminal pins 12. The contact pieces 25 that are welded on the contact making ends of the spring arms 21 respectively overlap two stationary contact elements 14. The ends of the armature 4 are bent slightly upward toward the pole shoes 54 to contribute to an additional reduction of the overall height of the relay.

In addition, during assembly, the desired armature stroke is easily adjustable. To that end, the coil 5, as well as the core 53 and the pole shoes 54 that are also surrounded by the insulating envelope 56, as well as the permanent magnet 6 that is arranged below the coil 5, are pushed onto the pedestal or base 1 that is equipped with the contact spring group 2 and the armature 4 until the desired armature stroke is obtained. Thereby, the envelope 56 of the coil has its bottom edge clamped on the base. With the help of a magnetic equalization, it is ensured that the relay will respond to the desired voltage.

Although various minor modifications may be suggested by those versed in the art, it should be understood that I wish to embody within the scope of the patent granted hereon all such modifications as reasonably and properly come within the scope of my contribution to the art.

I claim:

1. A polarized electromagnetic relay with a base body comprising an insulating material which defines a base plane with a bottom surface and in which terminal tracks for stationary contact elements as well as terminal elements for stationary and movable contact elements are embedded, a pivotable armature being arranged above the base body having a rotational axis extending parallel to the base plane and which is arranged between at least two contact springs of a contact spring group that is connected to the armature and are arranged to extend parallel to each other in a common plane, so that the contact springs cooperate with the stationary terminal elements in the base body corresponding to the movement of the armature, an envelope comprising insulating material which surrounds the contact springs in a central sector and from which two transverse terminal webs that are connected with the contact springs project in the area of the rotational axis of the armature so that the terminal webs are respectively connected with fastening tabs which have a sheet metal plane extending perpendicular to the base plane, a coil, whose axis runs parallel to the base plane and perpendicular to the rotational axis of the armature and whose winding terminal elements pass perpendicularly through the base plane, a core being arranged axially in the coil and to whose end pole shoes that are directed toward an armature connect and which form at least one working air gap with the armature and at least one bar-shaped permanent magnet being arranged parallel to the coil axis between the pole shoes to generate a like polarization at the ends of the pole shoes, the improvement comprising the coil being arranged above the armature, the terminal web having a sheet metal plane extending perpendicular to the base plane, each of the contact springs having two spring arms and a connecting web which extends perpendicular to the base plane, the spring arms having one contact making part and one part that is embedded in the envelope, whereby a part that is embedded in the envelope merges into the connecting web and the fastening tabs being respectively fastened at one center contact terminal pin that extends perpendicularly out of the base body.

2. A relay according to claim 1, wherein the terminal web is connected by a leaf spring web which represents an extension of the spring arm and which leaf spring web extends essentially parallel to the axis of the coil and has a sheet metal plane extending essentially parallel to the base plane to the region of the rotational axis of the armature.

3. A relay according to claim 1, wherein the fastening tab represents an extension of the terminal web that is bent toward the coil.

4. A relay according to claim 1, wherein the height of the vertical terminal web increases steadily from the side that faces the armature up to the fastening tab.

5. A relay according to claim 1, wherein the terminal web and the fastening tab connected thereto engage a center contact pin.

6. A relay according to claim 1, wherein each of the contact springs, which includes the connecting web, the terminal webs and the fastening tabs, are fabricated from one common sheet of metal.

7. A relay according to claim 1, wherein the envelope of the contact spring group exhibits a receptacle for the armature.

8. A relay according to claim 1, wherein the armature is fashioned planar and a coupling piece is arranged between the armature and the at least one permanent magnet.

9. A relay according to claim 8, wherein a center area of the armature is bent roughly half of a stroke angle toward the pole shoes.

10. A relay according to claim 1, wherein the base body forms a base for the relay which accepts the armature, the contact spring group, the coil together with the core and pole shoes which are surrounded by an insulating envelope, the insulating envelope together with the bottom side of the base forming a housing for the relay.

* * * * *